United States Patent [19]

Tuttle

[11] Patent Number: 4,823,650

[45] Date of Patent: Apr. 25, 1989

[54] POWER DRIVEN WIRE NUT WRENCH

[76] Inventor: John E. Tuttle, 19220 32nd Ave., NW., Stanwood, Wash. 98292

[21] Appl. No.: 130,641

[22] Filed: Dec. 9, 1987

[51] Int. Cl.[4] ..... B25B 13/06

[52] U.S. Cl. ..... 81/124.2; 81/176.15; 81/176.2

[58] Field of Search ..... 81/124.2, 121.1, 125, 81/176.1, 176.15, 176.2, 3.4; D8/29, 21, 14

[56] References Cited

U.S. PATENT DOCUMENTS

| | | | |
|---|---|---|---|
| 3,489,041 | 1/1970 | Havenstein et al. | 81/176.15 |
| 3,731,722 | 5/1973 | Carr | 81/125 X |
| 3,769,862 | 11/1973 | Miller | 81/176.1 |
| 3,787,948 | 1/1974 | Runge | 81/121.1 |
| 3,812,741 | 5/1974 | Heine | 81/3.4 |
| 4,679,468 | 7/1987 | Gray | 81/176.15 X |

FOREIGN PATENT DOCUMENTS

| | | | |
|---|---|---|---|
| 43104 | 5/1888 | Fed. Rep. of Germany | 81/3.4 |

*Primary Examiner*—Debra Meislin

*Attorney, Agent, or Firm*—Michael J. Tavella

[57] ABSTRACT

A power driven wrench is disclosed that is used to fasten and secure helical spring wire connectors commonly known as WING NUTS or WIRE NUTS. The invention consists of a cone shaped plastic housing and a hexagonal shaft that extends outwardly from the bottom of the housing. The shaft is placed within a chuck of standard power tools such as power screwdrivers or variable speed drills. The housing is open at the top and hollow inside to receive the connectors. Two slots are placed within the walls of the housing to receive and hold the wings or flanges of the connectors. A number of ribs, concentrically placed around the inner wall of the housing, are also provided to engage ribs placed on certain types of connectors that have no flanges. The ribs prevent free rotation of the connector within the housing. A magnet is also embedded within the bottom of the housing. The magnet holds the connector within the housing by attracting the helical spring found in typical connectors. The housing is made of high strength, non-conductive plastic.

7 Claims, 1 Drawing Sheet

POWER DRIVEN WIRE NUT WRENCH

BACKGROUND OF THE INVENTION

This invention is related to wrenches used to apply helical spring type wire connectors commonly known as Wing Nuts or Wire Nuts, and more particularly to wrenches for wire connectors that are used with power tools.

Spring loaded fasteners are used in electrical work to connect wires together. These fasteners have a conical shape and have either flanges or ribs that a worker can grip while the connector is applied. These devices are a big improvement over solder and tape splices and come in a variety of sizes. Spring loaded wire connectors have one major problem, however, their size tends to cause hand cramps and muscle fatigue after repeated installations. Proper connection torque is also difficult to achieve when many wires are connected together. To alleviate these difficulties, connector wrenches have been developed to make using the devices easier, and to ensure that all connections are properly torqued. One example of this type of wrench is found in U.S. Pat. No. 3,787,948, which discloses a wrench having an oblong head piece that has an opening sized to fit a typical wing type connector. A handle extends from the opposite end of the headpiece from the connector opening. The handle has a ratchet to allow the entire headpiece to rotate around the connector axis while the connector also rotates, thereby tightening the connector onto the wire. This device has several problems. First, the handle is offset from the opening, which makes the device awkward to use. Further, it is hard to obtain proper leverage to make a tight connection because of the thin handle.

Other devices include a small wrench device that is designed to accommodate two different sized connectors. This device is ovoid in shape, and has two connector receptacles placed side-by-side in the base. This device is small and must be held by the fingers, much like a wire connector. This device, therefore, will cause the same hand cramps with repeated use as do the connectors. Also, its small size makes it difficult to obtain good leverage to make solid connections when used on heavy gauge wires.

Another device is simply a screwdriver that has a hole drilled in its base that is sized to fit a connector. Although this device has some advantages over the others, is also has a metal blade extending from the opposite end. This produces a potential safety problem if the device is used around live electrical circuits. Also the blade could cause injury when the device is being used. The latter devices are produced by Ideal Industries, Incorporated, Sycamore, Ill. All of these devices are intended to be used manually. The present invention is a device that is intended for use with power tools such as power screw drivers or variable speed drills.

BRIEF DESCRIPTION OF THE INVENTION

The present invention consists of a clear plastic housing that has good dielectric properties. The housing is tapered inwards toward the bottom of the housing, forming a generally conical shape, and is hollow on the inside. Wire connectors are placed within the hollow interior of the housing through the top of the device, which is open. The housing has two, oppositely disposed slots which are used to receive the flanges typically found on wire connectors. The housing also has a series of ribs placed concentrically along the inner wall of the housing. The ribs are used to engage a similar set of ribs found on certain types of wire connectors.

A shaft is attached to the bottom of the housing. The shaft can be round or hexagonal and is inserted into the chuck of standard power tools such as variable speed drills or power screwdrivers.

A magnet is embedded within the bottom of the housing. The magnet is used to attract and hold the spring typically found in all spring loaded wire connectors, once the connector is inserted into the housing.

It is the object of the invention to provide a power driven wire nut wrench for use with all types of wire connectors.

DETAILED DESCRIPTION OF THE PREFERRED EMBODIMENT

Figure 1:
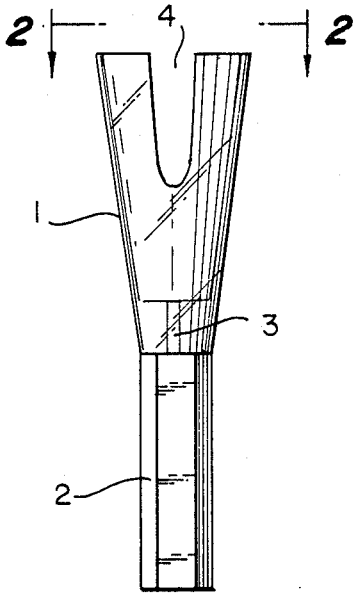
FIG. 1 is a side view of the invention.
Figure 2:
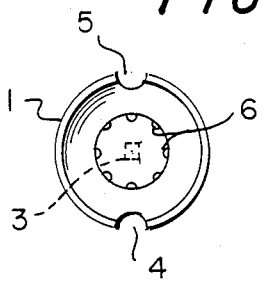
FIG. 2 is a top view of the invention along the lines 2—2.

Referring now to the drawing figures, and more particularly to FIG. 1, the invention consists of a clear, high impact plastic housing 1. Although the housing 1 is clear plastic in the preferred embodiment, it can be manufactured from any similar lightweight, non-conductive material. The housing 1 is fastened to a shaft 2 by either sonic welding, embedding the shaft in the plastic housing, or other means known to the art. In the preferred embodiment, the shaft 2 is hexagonal in shape to provide a stronger gripping surface within the power tool's chuck. However, the shaft 2 can also be cylindrical or any other form common to the art. A magnet 3 is also embedded within the housing, at the shaft end, as shown in the drawings. The magnet 3 is designed to attract and hold the helical spring that is placed in all of the type of wire connectors that this device is intended for (see, e.g., FIG. 4). The housing 1 has two slots 4 and 5, placed on opposite sides of the housing 1 as shown. The slots 4 and 5 hold the flange portion of the connectors (see FIGS. 3, 4, and 6). A plurality of ribs 6 are spaced equally around the inner wall as shown. The ribs 6 run the length of the housing 1 and are designed to hold the type of connectors found in FIG. 5, which have no flanges, but are ribbed to provide a gripping surface.

Figure 4:
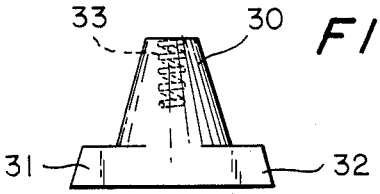
FIG. 4 is a detail of a second type of wire connector.
Figure 3:
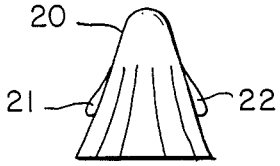
FIG. 3 is a detail of one type of connector.
Figure 5:
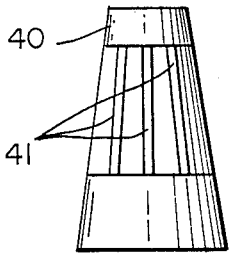
FIG. 5 is a detail of a third type of wire connector.
Figure 6:
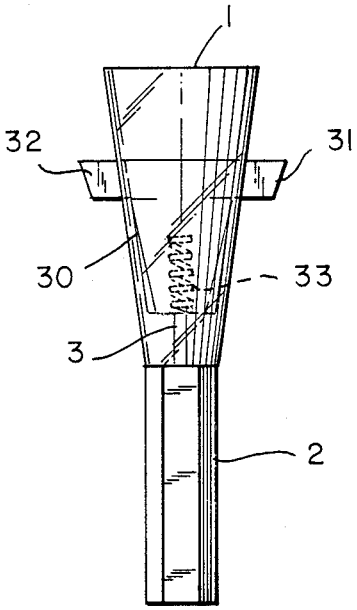
FIG. 6 is a detail view of a typical wire connector inserted in the device prior to use.
Figure 7:
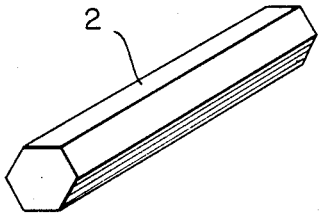
FIG. 7 is a detail view of a hexagonal shaped shaft, which is an alternative shaft design.

Referring now to FIGS. 3, 4 and 5, wire connectors are produced under a variety of trade names and have three main designs:

FIG. 3 shows a connector 20 that has a soft plastic coating and two protrusions, 21 and 22, that extend from the middle portion of the connector body. FIG. 4 shows a second type of connector 30 that has a hard plastic shell. The shell has two wings, 31 and 32, that extend from the base of the housing. This figure also shows that helical spring 33, which is installed in all types of these connectors. FIG. 5 shows a third type of connector 40 that has no protrusions or wings. This connector has a hard plastic shell and a plurality of ribs 41 to provide a gripping surface for the connector's intallation.

The device is used by inserting the shaft 2 into the chuck of a standard power screwdriver or variable speed drill and then locking the chuck around the shaft 2. A wire connector of any type is then inserted into the housing until it is firmly seated (see e.g., FIG. 6). The wire connector is then placed over the bared ends of the wires to be connected and the power tool is activated, which rotates the connector around the wires until the connection is complete. The power tool can then be pulled directly off of the connector and the housing 1 is then ready to receive another connector.

It is intended that the present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to modification by skilled persons within the scope of the invention without departing from the concept thereof.

I claim:

1. A wrench for the installation of helical spring wire connectors, having either two outwardly extending diametrically opposed wing portions or a plurality of vertically extending grooves space equally about the outer surface thereof, for use in power tools having locking jaws or chucks, comprising:

(a) a tapered housing having an outer wall and an inner wall and having a generally conical shape and having an internal cavity, said housing also having a top and a bottom, said top being open thereby allowing access to the internal cavity of said housing, said top having a larger diameter than said bottom, said housing also having slot means integrally formed therein to secure said wing portions of said helical spring wire connectors having wing portions, said housing also having grip means integrally formed thereon to grip and secure the grooves of said helical spring type wire connectors, having grooves thereon;

(b) shaft means fixedly attached to said bottom of said housing and extending outwardly therefrom, said shaft means being longer than wider, said shaft means being sized to be held in the chuck of said power tools.

2. The device of claim 1 further comprising a magnet, fixedly installed within the bottom of said housing.

3. The device of claim 1 wherein said slot means comprises said housing having two recessed openings, within and through said inner and outer walls, extending downwardly therethrough and being open at the top of said housing such that the wing portions of said helical spring wire connectors can be placed and held therein, said recessed openings being in opposite disposition within the walls of said housing.

4. The device of claim 1 wherein said grip means comprise a plurality of ribs fixedly installed and concentrically placed on said inner wall of said housing such that said grooves of said helical spring wire connectors engages with the ribs in said housing, thereby preventing the free rotation of the helical spring wire connector within said housing.

5. The device of claim 1 wherein said shaft means has a hexagonal shape to provide increased gripping force within said chuck of said power tools.

6. A wrench for the installation of helical spring wire connectors, having either two outwardly extending diametrically opposed wing portions or a plurality of vertically extending grooves spaced equally about the outer surface thereof, for use in power tools having locking jaws or chucks comprising:

(a) a housing being conically shaped having a top and a bottom and an inner and an outer wall, also having two recessed openings within and through said inner and outer walls, extending downwardly therethrough and also being open at the top of said housing such that the wing portions of said helical spring wire connectors can be placed and held therein, said recessed openings being in opposite disposition within the walls of said housing;

(b) a plurality of ribs fixedly installed and concentrically placed on said inner wall of said housing such that said grooves of said helical spring wire connectors engages with the ribs in said housing, thereby preventing the free rotation of the helical spring wire connector within said housing;

(c) shaft means fixedly attached to the bottom of said housing and extending outwardly therefrom and having a hexagonal shape to provide increased gripping force when placed and locked within said chuck of said power tools; and (d) a magnet, fixedly installed within the bottom of said housing.

7. The device on claim 1 wherein said shaft is cylindrical.

* * * * *